US009060574B2

(12) United States Patent
Lin

(10) Patent No.: US 9,060,574 B2
(45) Date of Patent: Jun. 23, 2015

(54) CAP STRUCTURE HAVING AN INNER SURFACE CONCAVE FEATURE AND ZIPPER HEAD ASSEMBLY STRUCTURE USING THE SAME

(71) Applicant: CHUNG CHWAN ENTERPRISE CO., LTD., Tao Yuan Hsien (TW)

(72) Inventor: Yu-Pau Lin, Taoyuan County (TW)

(73) Assignee: CHUNG CHWAN ENTERPRISE CO., LTD., Tao Yuan Hsien (TW)

( * ) Notice: Subject to any disclaimer, the term of this patent is extended or adjusted under 35 U.S.C. 154(b) by 85 days.

(21) Appl. No.: 13/935,664

(22) Filed: Jul. 5, 2013

(65) Prior Publication Data

US 2014/0338158 A1 Nov. 20, 2014

(30) Foreign Application Priority Data

May 20, 2013 (TW) ..... 102117733 A

(51) Int. Cl.

| | |
|---|---|
| ***A44B 19/26*** | (2006.01) |
| ***A44B 19/30*** | (2006.01) |
| ***A44B 19/24*** | (2006.01) |

(52) U.S. Cl.

CPC ..... *A44B 19/308* (2013.01); *Y10T 24/2589* (2015.01); *A44B 19/26* (2013.01); *Y10T 24/2561* (2015.01); *Y10T 24/2586* (2015.01); *A44B 19/24* (2013.01)

(58) Field of Classification Search

CPC ..... A44B 19/308; A44B 19/26
USPC ..... 24/415–431, 433, 435
See application file for complete search history.

(56) References Cited

U.S. PATENT DOCUMENTS

| | | | | |
|---|---|---|---|---|
| 2,373,523 | A * | 4/1945 | Winterhalter | 24/421 |
| 4,271,567 | A | 6/1981 | Aoki | |
| 5,664,300 | A * | 9/1997 | Mizuno | 24/424 |
| 6,993,810 | B2 * | 2/2006 | Hamada | 24/424 |
| 7,464,445 | B1 * | 12/2008 | Lin | 24/415 |
| 2008/0222854 | A1 * | 9/2008 | Keyaki et al. | 24/429 |
| 2009/0313793 | A1 * | 12/2009 | Lin | 24/429 |
| 2012/0131768 | A1 * | 5/2012 | Lin | 24/415 |
| 2012/0180273 | A1 * | 7/2012 | Keyaki et al. | 24/429 |

(Continued)

FOREIGN PATENT DOCUMENTS

| | | |
|---|---|---|
| JP | 08-322611 | 12/1996 |
| KR | 10-0518694 | 5/2004 |

(Continued)

*Primary Examiner* — Robert J Sandy
*Assistant Examiner* — Louis Mercado
(74) *Attorney, Agent, or Firm* — Li & Cai Intellectual Property (USA) Office

(57) ABSTRACT

A cap structure includes a cap body and an elastic piece. The cap body has at least two first inner concave grooves corresponding to each other, at least two first retaining blocks corresponding to each other and respectively extended outwardly from the at least two first inner concave grooves, and at least two first outer concave grooves corresponding to each other and respectively adjacent to the at least two first retaining blocks. The at least two first inner concave grooves are disposed on the inner surface of the cap body, and the at least two first outer concave grooves are disposed on the outer surface of the cap body. The elastic piece is disposed on the inner surface of the cap body, and the at least two first retaining blocks contact the elastic piece for retaining the elastic piece.

13 Claims, 7 Drawing Sheets

(56) References Cited

U.S. PATENT DOCUMENTS

| | | | | |
|---|---|---|---|---|
| 2013/0276270 | A1* | 10/2013 | Hamada et al. | 24/427 |
| 2013/0318751 | A1* | 12/2013 | Lin | 24/429 |

FOREIGN PATENT DOCUMENTS

| | | |
|---|---|---|
| TW | 571649 | 1/2004 |
| TW | I367733 | 7/2012 |

* cited by examiner

CAP STRUCTURE HAVING AN INNER SURFACE CONCAVE FEATURE AND ZIPPER HEAD ASSEMBLY STRUCTURE USING THE SAME

BACKGROUND OF THE INVENTION

1. Field of the Invention

The instant disclosure relates to a cap structure and a zipper head assembly structure using the same, and more particularly to a cap structure having an inner surface concave feature and a zipper head assembly structure using the same.

2. Description of Related Art

In general, zippers are basic elements in clothing or accessories. Compare to buttons, the zippers are easier to use. A conventional zipper comprises a zipper head and a tape. The zipper head works with the tape to allow the pulling action. Recently, the zipper has been used commonly for clothing, pants, backpack, and other accessories.

A conventional zipper head assembly structure comprises a fastening slider, a pulling piece, a horse-like hook and a cap. The above components of the conventional zipper head assembly structure are assembled in the following procedure. One end portion of the pulling piece is positioned into a recessed space of the fastening slider. The pulling piece is pushed toward one end of the fastening slider, so that a first fixing base or a second fixing base of the fastening slider can be put around a hole of the pulling piece. Then, the horse-like hook is fixed to the first fixing base and the second fixing base of the fastening slider. The head portion of the horse-like hook is positioned in a groove of the first fixing base, while the tail portion of the horse-like hook is positioned to abut against the bottom of the groove of the second fixing base. The abdominal portion of the horse-like hook is supported on the end portion of the pulling piece. The stop portion of the horse-like hook extends into a sliding groove of the fastening slider via a horse-like hook hole between the first fixing base and the second fixing base. Finally, the cap is used to cover on the first fixing base and the second fixing base of the fastening slider. An elastic piece is inserted into the interior of the cap for abutting on the horse-like hook.

SUMMARY OF THE INVENTION

One aspect of the instant disclosure relates to a cap structure having an inner surface concave feature and a zipper head assembly structure using the same.

One of the embodiments of the instant disclosure provides a cap structure having an inner surface concave feature, comprising: a cap body and an elastic piece. The cap body has at least two first retaining blocks corresponding to each other and at least two first outer concave grooves corresponding to each other and respectively adjacent to the at least two first retaining blocks, wherein the cap body has an inner surface, an outer surface and a bottom surface connected between the inner surface and the outer surface, and the at least two first outer concave grooves are disposed on the outer surface of the cap body. The elastic piece is disposed on the inner surface of the cap body, wherein the at least two first retaining blocks contact the elastic piece for retaining the elastic piece.

Another one of the embodiments of the instant disclosure provides a zipper head assembly structure, comprising: a sliding member, a pull tab, a locking hook, a cap body and an elastic piece. The sliding member has a first retaining seat and a second retaining seat, wherein the first retaining seat has a hook groove, and the second retaining seat has a hook hole. The pull tab has an end portion disposed between the first retaining seat and the second retaining seat. The locking hook is disposed on the sliding member, wherein the locking hook has a first end portion disposed inside the hook groove and a second end portion passing through the hook hole. The cap body has two opposite end portions respectively disposed on the first retaining seat and the second retaining seat, wherein the cap body has at least two first retaining blocks corresponding to each other and at least two first outer concave grooves corresponding to each other and respectively adjacent to the at least two first retaining blocks, wherein the cap body has an inner surface, an outer surface and a bottom surface connected between the inner surface and the outer surface, and the at least two first outer concave grooves are disposed on the outer surface of the cap body. The elastic piece is disposed between the inner surface of the cap body and the locking hook and abutted against the locking hook, wherein the at least two first retaining blocks contact the elastic piece for retaining the elastic piece.

More precisely, the cap body has at least two first inner concave grooves corresponding to each other, the two first retaining blocks are respectively and outwardly extended from the two first inner concave grooves, and the two first inner concave grooves are disposed on the inner surface of the cap body.

More precisely, the two first inner concave grooves are diagonally disposed on the inner surface of the cap body, and the two first inner concave grooves are respectively adjacent to two opposite end sides of the cap body, wherein the two first retaining blocks are respectively and diagonally disposed on the two first inner concave grooves, and the two first retaining blocks are respectively adjacent to the two opposite end sides of the cap body, wherein the two first outer concave grooves are diagonally disposed on the outer surface of the cap body, and the two first outer concave grooves are respectively adjacent to the two opposite end sides of the cap body.

More precisely, each first inner concave groove has a first end connected to the bottom surface of the cap body and a second end opposite to the first end and far away from the bottom surface of the cap body, and the width of the first inner concave groove is narrowed gradually from the first end to the second end of the first inner concave groove.

More precisely, each first retaining block is adjacent to the second end of the corresponding first inner concave groove, the length of the first retaining block is increased gradually along a first direction from the first end to the second end of the first inner concave groove, the width of the first retaining block is narrowed gradually along a second direction far away from the first inner concave groove, and the height of the first retaining block is decreased gradually along the second direction far away from the first inner concave groove.

More precisely, each first outer concave groove is adjacent to the second end of the corresponding first inner concave groove, the length of the first outer concave groove is increased gradually along a first direction from the first end to the second end of the first inner concave groove, the width of the first outer concave groove is narrowed gradually along a second direction from the outer surface to the inner surface of the cap body, and the height of the first outer concave groove is decreased gradually along the second direction from the outer surface to the inner surface of the cap body.

More precisely, the cap body has at least two second inner concave grooves corresponding to each other, at least two second retaining blocks corresponding to each other and respectively extended outwardly from the two second inner concave grooves, and at least two second outer concave grooves corresponding to each other and respectively adjacent to the two second retaining blocks, the two second inner concave grooves are disposed on the inner surface of the cap body, the two second outer concave grooves are disposed on the outer surface of the cap body, and the two second retaining blocks contact the elastic piece for retaining the elastic piece.

More precisely, the two second inner concave grooves are diagonally disposed on the inner surface of the cap body, and the two second inner concave grooves are respectively adjacent to two opposite end sides of the cap body, wherein the two second retaining blocks are respectively and diagonally disposed on the two second inner concave grooves, and the two second retaining blocks are respectively adjacent to the two opposite end sides of the cap body, wherein the two second outer concave grooves are diagonally disposed on the outer surface of the cap body, and the two second outer concave grooves are respectively adjacent to the two opposite end sides of the cap body.

Therefore, the at least two second inner concave grooves can be formed on the inner surface of the cap body by a die casting process and the at least two first retaining blocks and the at least two first outer concave grooves can be concurrently formed by a dotting or punching machine, so that when the elastic piece is disposed on the inner surface of the cap body, the at least two first retaining blocks can contact the elastic piece for retaining the elastic piece, thus the production efficiency of manufacturing the cap structure and the robustness of retaining the elastic piece by the at least two first retaining blocks can be increased.

To further understand the techniques, means and effects of the instant disclosure applied for achieving the prescribed objectives, the following detailed descriptions and appended drawings are hereby referred, such that, through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

First Embodiment

Figure 1:
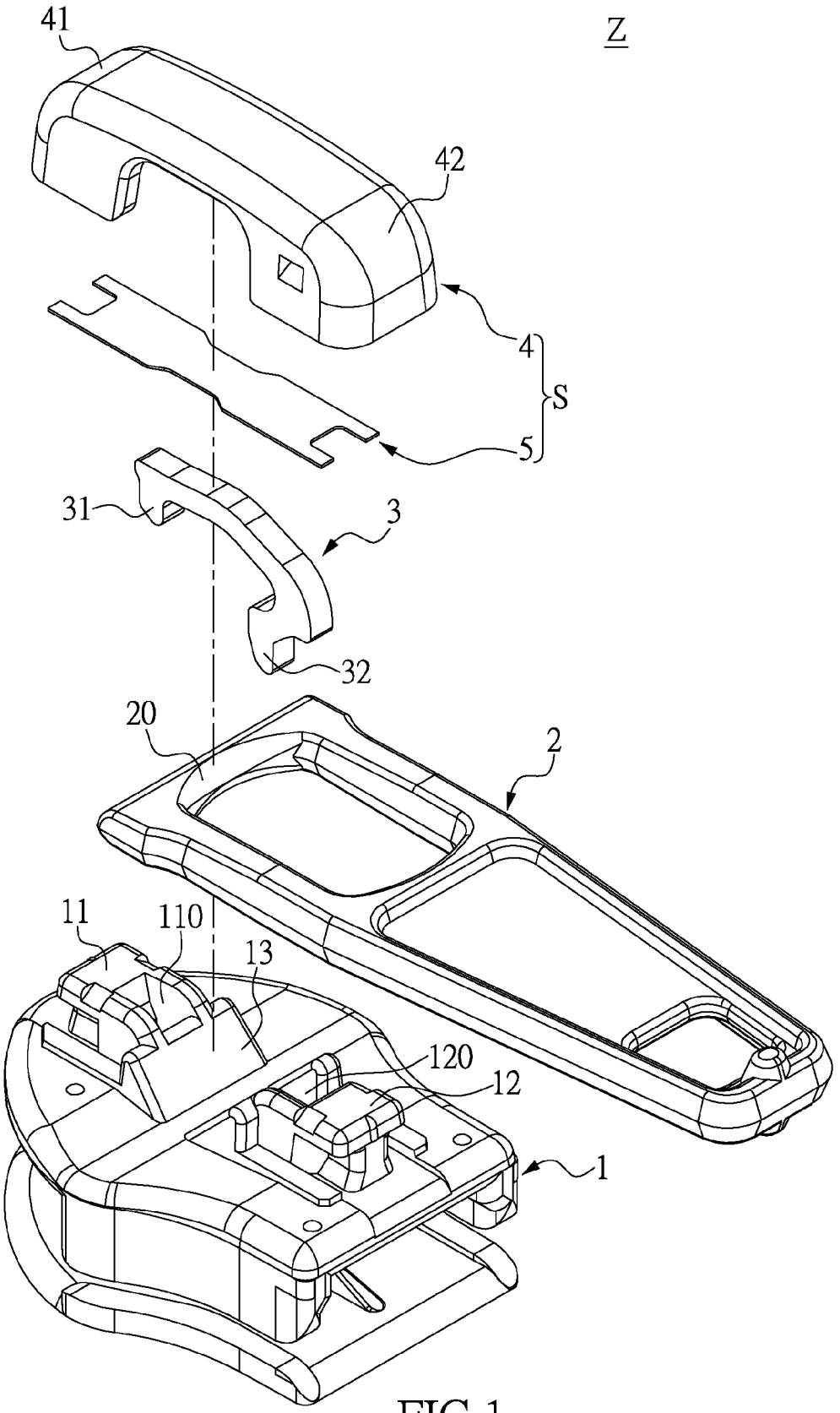
FIG. 1 shows a perspective, exploded, schematic view of the zipper head assembly structure according to the first embodiment of the instant disclosure.

Referring to FIG. 1 to FIG. 6, where the first embodiment of the instant disclosure a zipper head assembly structure Z, comprising: a sliding member 1 (or a sliding head), a pull tab 2 (or a pull piece), a locking hook 3 (or a horse-like hook), a cap body 4 and an elastic piece 5 (or a flat spring), and the cap body 4 and the elastic piece 5 can be combined with each other to form a cap structure S having an inner surface concave feature.

Figure 2:
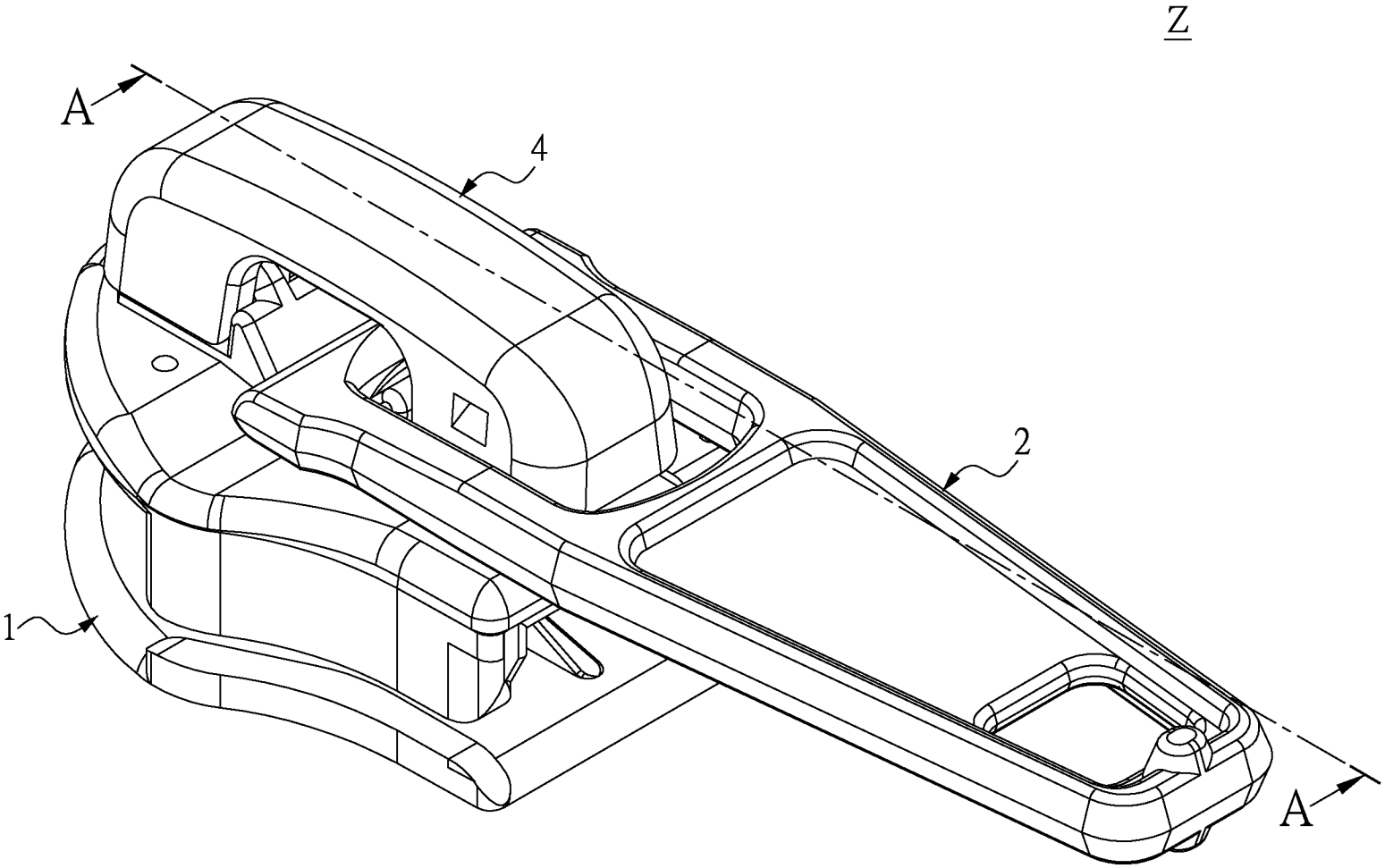
FIG. 2 shows a perspective, assembled, schematic view of the zipper head assembly structure according to the first embodiment of the instant disclosure.
Figure 3:
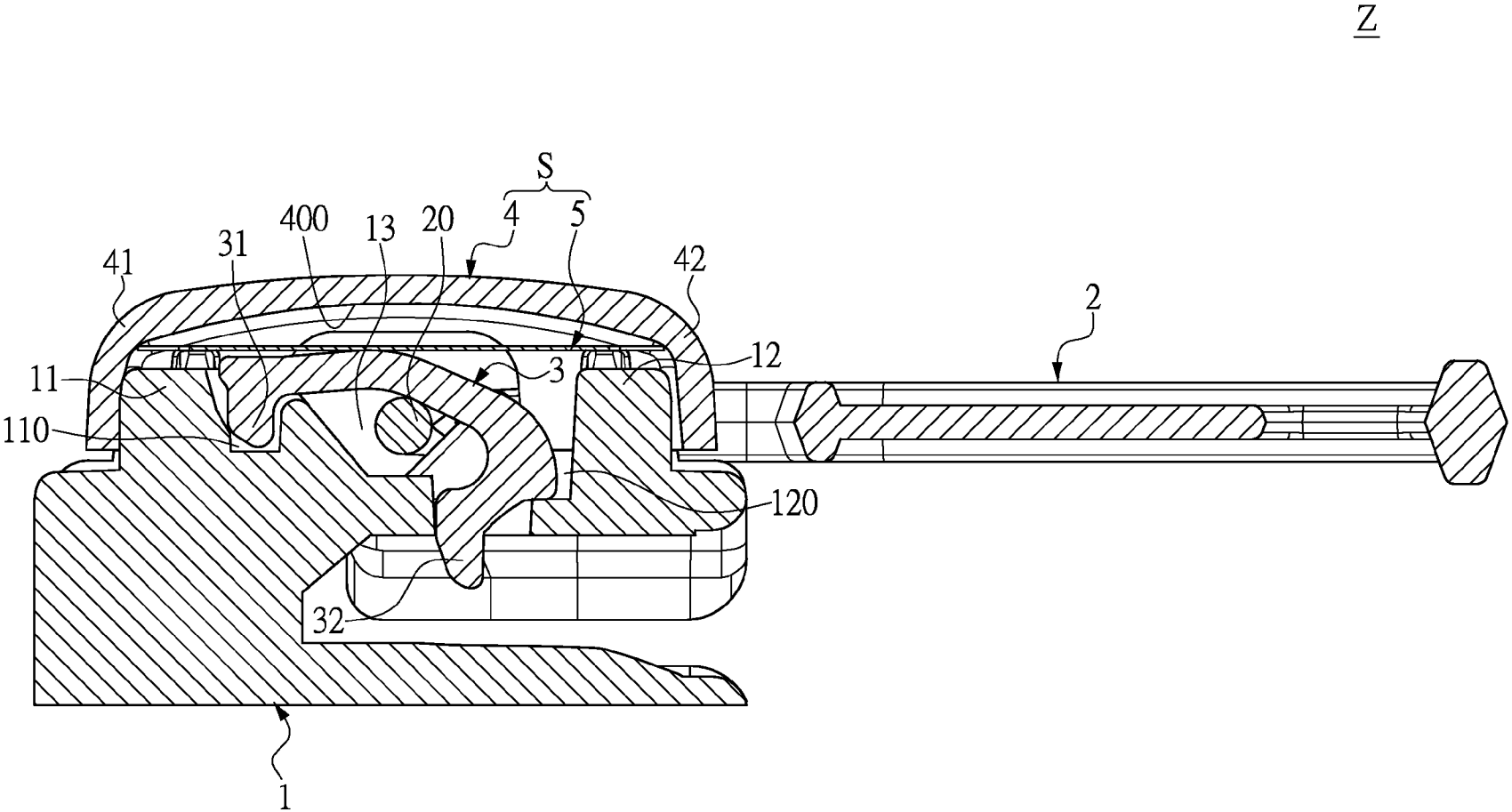
FIG. 3 shows a cross-sectional view taken along the section line A-A of FIG. 2.

First, referring to FIG. 1 to FIG. 3, the sliding member 1 has a first retaining seat 11 and a second retaining seat 12. The first retaining seat 11 has a hook groove 100 shown as a blind hole, and the second retaining seat 12 has a hook hole 120 shown as a through hole. The pull tab 2 has an end portion 20 disposed inside a receiving space 13 formed between the first retaining seat 11 and the second retaining seat 12. The locking hook 3 is disposed on the sliding member 1, and the locking hook 3 has a first end portion 31 disposed inside the hook groove 110 and a second end portion 32 opposite to the first end portion 31 and passing through the hook hole 120 to form a stop portion. The cap body 4 has two opposite end portions (41, 42) respectively disposed on the first retaining seat 11 and the second retaining seat 12, the elastic piece 5 is disposed between the inner surface 400 of the cap body 4 and the locking hook 3 and abutted against the locking hook 3, and both the locking hook 3 and the elastic piece 5 are disposed between the sliding member 1 and the cap body 4 (as shown in FIG. 2 and FIG. 3).

Figure 4:
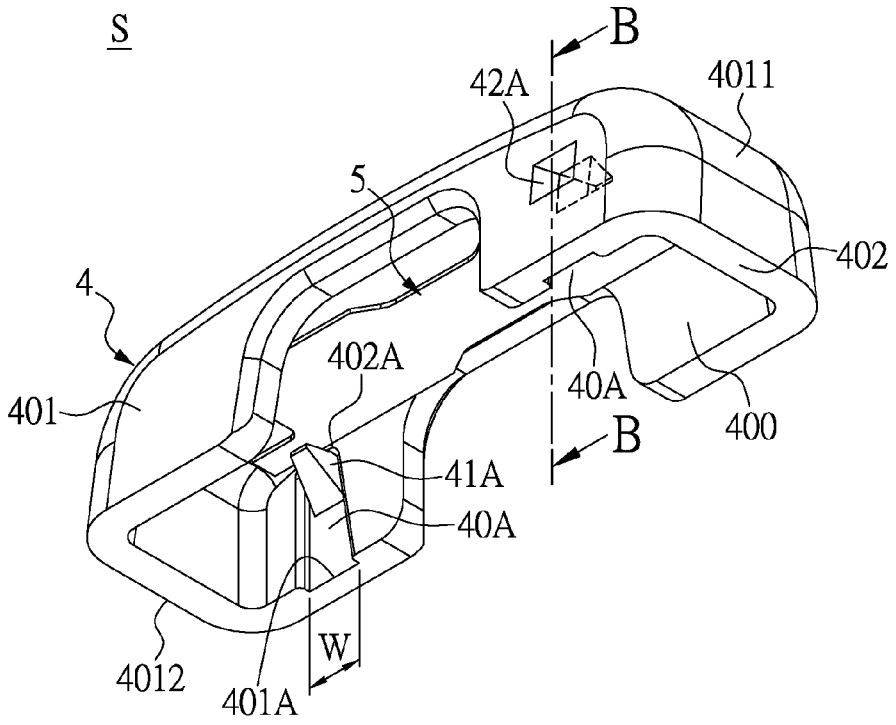
FIG. 4 shows a perspective, schematic view of the cap structure according to the first embodiment of the instant disclosure.
Figure 5:
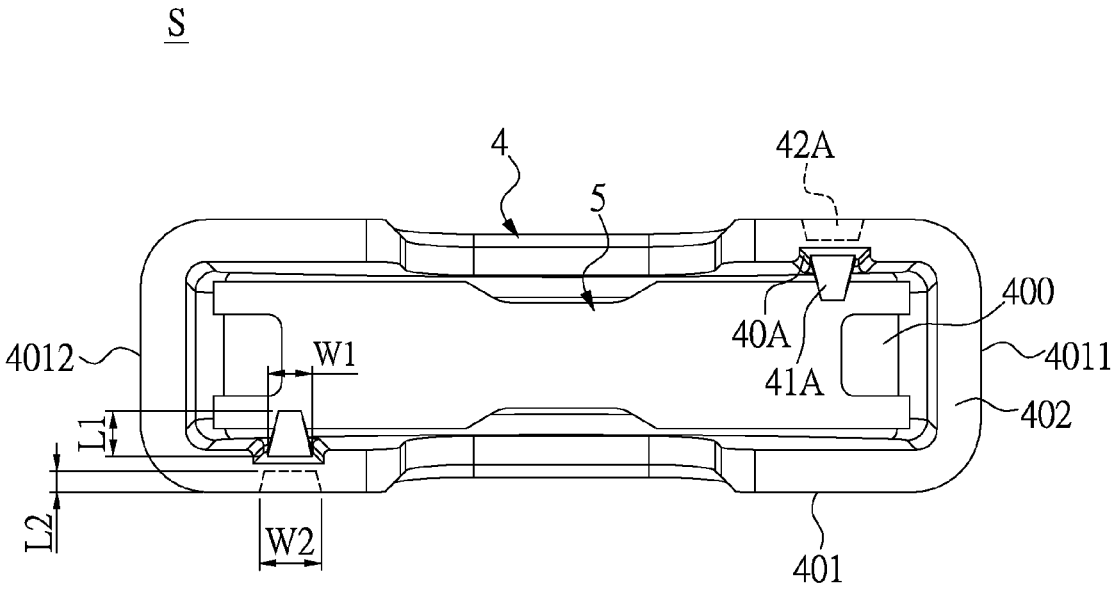
FIG. 5 shows a bottom, schematic view of the cap structure according to the first embodiment of the instant disclosure.
Figure 6:
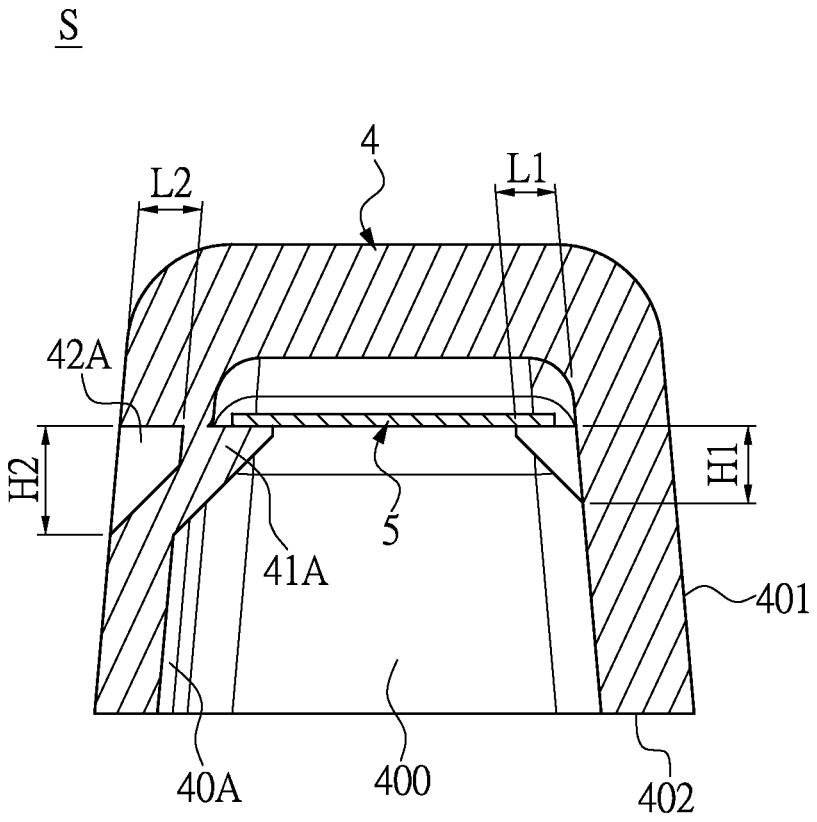
FIG. 6 shows a cross-sectional view taken along the section line B-B of FIG. 4.

Moreover, referring to FIG. 4 to FIG. 6, the cap body 4 has at least two first inner concave grooves 40A (i.e., the inner surface concave feature) corresponding to each other, at least two first retaining blocks 41A corresponding to each other and respectively extended outwardly from the two first inner concave grooves 40A, and at least two first outer concave grooves 42A corresponding to each other and respectively adjacent to the two first retaining blocks 41A. The two first retaining blocks 41A can contact the elastic piece 5 for retaining the elastic piece 5 (i.e., the elastic piece 5 can be retained inside the cap body 4 through the two first retaining blocks 41A). In addition, the cap body 4 has an inner surface 400, an outer surface 401 and a bottom surface 402 connected between the inner surface 400 and the outer surface 401, the two first inner concave grooves 40A are disposed on the inner surface 400 of the cap body 4, and the two first outer concave grooves 42A are disposed on the outer surface 401 of the cap body 40. Whereby, the two first inner concave grooves 40A can be formed on the inner surface 400 of the cap body 4 in advance, so that the thickness between the inner surface 400 and the outer surface 401 of the cap body 4 can be decreased or thinned, thus it is easy to concurrently form the first outer concave groove 42A and the first retaining block 41A by a dotting or punching machine More precisely, referring to FIG. 5, the two first inner concave grooves 40A can be diagonally disposed on the inner surface 400 of the cap body 4, and the two first inner concave grooves 40A are respectively adjacent to two opposite end sides (4011, 4012) of the cap body 4. The two first retaining blocks 41A can be respectively and diagonally disposed on the two first inner concave grooves 40A, and the two first retaining blocks 41A are respectively adjacent to the two opposite end sides (4011, 4012) of the cap body 4. The two first outer concave grooves 42A can be diagonally disposed on the outer surface 401 of the cap body 4, and the two first outer concave grooves 42A are respectively adjacent to the two opposite end sides (4011, 4012) of the cap body 4. In other words, the two first inner concave grooves 40A and the two first retaining blocks 41A are disposed on the long lateral side of the inner surface 400 of the cap body 4, and the two first outer concave grooves 42A are disposed on the long lateral side of the outer surface 401 of the cap body 4. Therefore, the position of the first inner concave groove 40A, the first retaining block 41A or the first outer concave groove 42A is turned relative to the end side (4011 or 4012) of the cap body 4 by 90 degrees.

For example, referring to FIG. 4, each first inner concave groove 40A has a first end 401A connected to the bottom surface 402 of the cap body 4 and a second end 402A opposite to the first end 401A and far away from the bottom surface 402 of the cap body 4, and the width W of the first inner concave groove 40A is narrowed gradually from the first end 401A to the second end 402A of the first inner concave groove 40A. However, the above-mentioned design for the first inner concave groove 40A of the first embodiment is merely an example and is not meant to limit the instant disclosure.

More precisely, referring to FIG. 5 and FIG. 6, each first retaining block 41A is adjacent to the second end 402A of the corresponding first inner concave groove 40A. In addition, the length L1 of the first retaining block 41A is increased gradually along a first direction from the first end 401A to the second end 402A of the first inner concave groove 40A, the width W1 of the first retaining block 41A is narrowed gradually along a second direction far away from the first inner concave groove 40A, and the height H1 of the first retaining block 41A is decreased gradually along the second direction far away from the first inner concave groove 40A. In other words, the first retaining block 41A may be formed as a quadrangular pyramid projected outwardly from the first inner concave groove 40A, and the cross-sectional area of the first retaining block 41A is decreased gradually along the direction far away from the first inner concave groove 40A. However, the above-mentioned design for the first retaining block 41A of the first embodiment is merely an example and is not meant to limit the instant disclosure.

More precisely, referring to FIG. 5 and FIG. 6, each first outer concave groove 42A is adjacent to the second end 402A of the corresponding first inner concave groove 40A. In addition, the length L2 of the first outer concave groove 42A is increased gradually along a first direction from the first end 401A to the second end 402A of the first inner concave groove 40A, the width W2 of the first outer concave groove 42A is narrowed gradually along a second direction from the outer surface 401 to the inner surface 400 of the cap body 4, and the height H2 of the first outer concave groove 42A is decreased gradually along the second direction from the outer surface 401 to the inner surface 400 of the cap body 4. However, the above-mentioned design for the first outer concave groove 42A of the first embodiment is merely an example and is not meant to limit the instant disclosure.

Second Embodiment

Referring to FIG. 7 to FIG. 10, where the second embodiment of the instant disclosure a zipper head assembly structure Z, and the cap body 4 and the elastic piece 5 can be combined with each other to form a cap structure S having an inner surface concave feature. Comparing FIGS. 4-6 with FIGS. 7-10, the difference between the second embodiment and the first embodiment is as follows: in the second embodiment, referring to FIG. 7 to FIG. 10, the cap body 4 has at least two second inner concave grooves 40B (i.e., the inner surface concave feature) corresponding to each other, at least two second retaining blocks 41B corresponding to each other and respectively extended outwardly from the two second inner concave grooves 40B, and at least two second outer concave grooves 42B corresponding to each other and respectively adjacent to the two second retaining blocks 41B. In addition, the two second inner concave grooves 40B are disposed on the inner surface 400 of the cap body 4, the two second outer concave grooves 42B are disposed on the outer surface 401 of the cap body 4, and the two second retaining blocks 41B contact the elastic piece 5 for retaining the elastic piece 5. Whereby, the two second inner concave grooves 40B can be formed on the inner surface 400 of the cap body 4 in advance, so that the thickness between the inner surface 400 and the outer surface 401 of the cap body 4 can be decreased or thinned, thus it is easy to concurrently form the second outer concave groove 42B and the second retaining block 41B by a dotting or punching machine.

Figure 8:
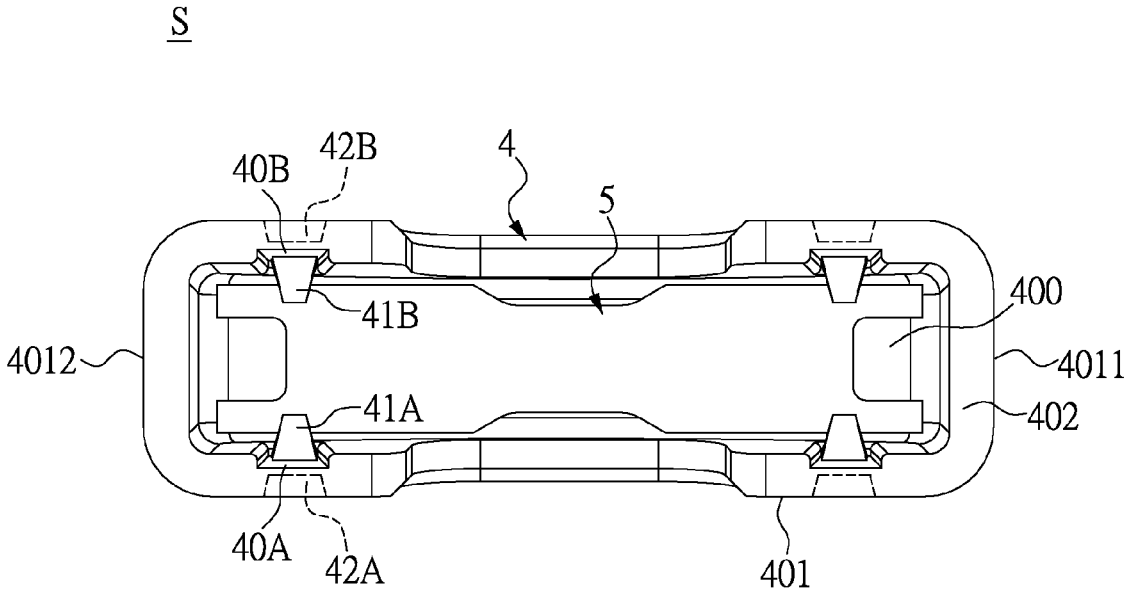
FIG. 8 shows a bottom, schematic view of the cap structure according to the second embodiment of the instant disclosure.
Figure 9:
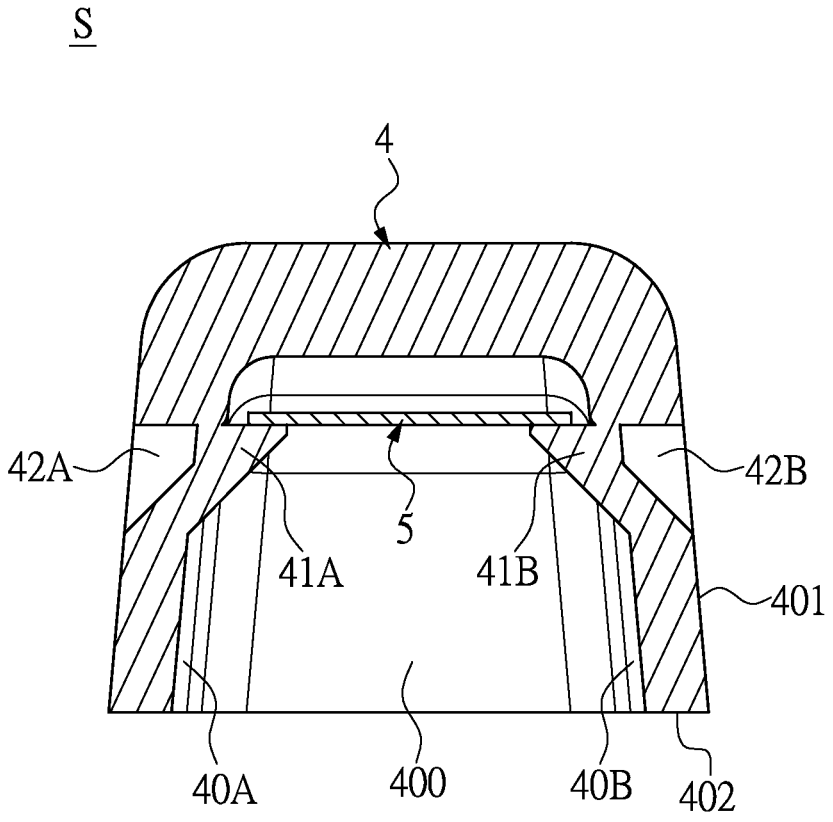
FIG. 9 shows a cross-sectional view taken along the section line C-C of FIG. 7.

More precisely, referring to FIG. 8, the two second inner concave grooves 40B can be diagonally disposed on the inner surface 400 of the cap body 4, and the two second inner concave grooves 40B are respectively adjacent to two opposite end sides (4011, 4012) of the cap body 4. The two second retaining blocks 41B can be respectively and diagonally disposed on the two second inner concave grooves 40B, and the two second retaining blocks 41B are respectively adjacent to the two opposite end sides (4011, 4012) of the cap body 4. The two second outer concave grooves 42B can be diagonally disposed on the outer surface 401 of the cap body 4, and the two second outer concave grooves 42B are respectively adjacent to the two opposite end sides (4011, 4012) of the cap body 4.

Figure 7:
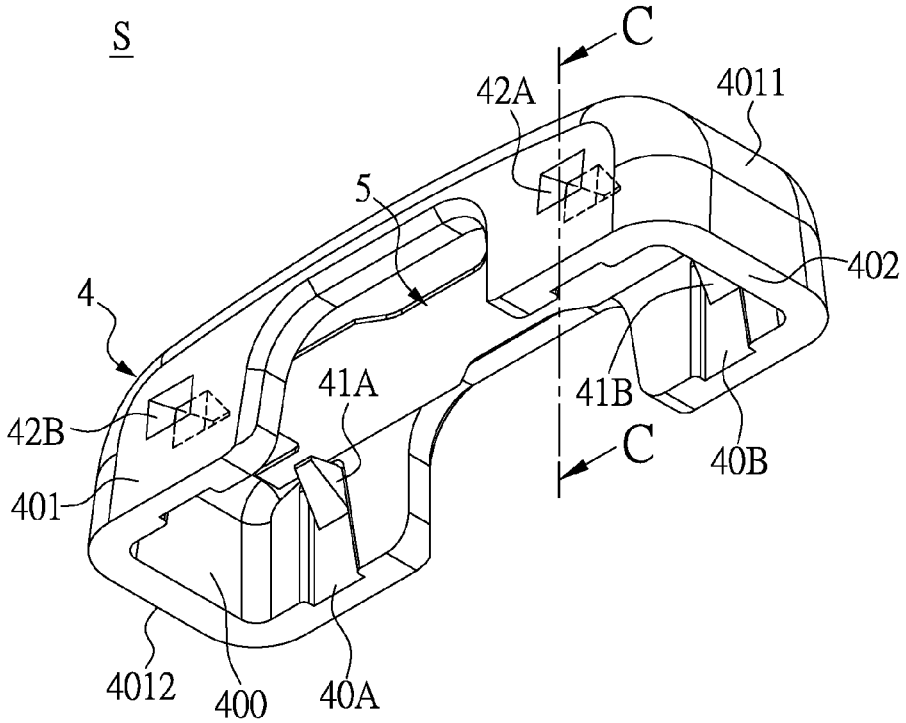
FIG. 7 shows a perspective, schematic view of the cap structure according to the second embodiment of the instant disclosure.

For example, referring to FIG. 4 and FIG. 7, each second inner concave groove 40B has a second end 401B connected to the bottom surface 402 of the cap body 4 and a second end 402B opposite to the second end 401B and far away from the bottom surface 402 of the cap body 4, and the width (no label) of the second inner concave groove 40B is narrowed gradually from the second end 401B to the second end 402B of the second inner concave groove 40B. However, the above-mentioned design for the second inner concave groove 40B of the first embodiment is merely an example and is not meant to limit the instant disclosure.

More precisely, referring to FIG. 5, FIG. 6, FIG. 8 and FIG. 9, each second retaining block 41B is adjacent to the second end 402B of the corresponding second inner concave groove 40B. In addition, the length (no label) of the second retaining block 41B is increased gradually along a second direction from the second end 401B to the second end 402B of the second inner concave groove 40B, the width (no label) of the second retaining block 41B is narrowed gradually along a second direction far away from the second inner concave groove 40B, and the height (no label) of the second retaining block 41B is decreased gradually along the second direction far away from the second inner concave groove 40B. In other words, the second retaining block 41B may be formed as a quadrangular pyramid projected outwardly from the second inner concave groove 40B, and the cross-sectional area of the second retaining block 41B is decreased gradually along the direction far away from the second inner concave groove 40B. However, the above-mentioned design for the second retaining block 41B of the first embodiment is merely an example and is not meant to limit the instant disclosure.

More precisely, referring to FIG. 5, FIG. 6, FIG. 8 and FIG. 9, each second outer concave groove 42B is adjacent to the second end 402B of the corresponding second inner concave groove 40B. In addition, the length (no label) of the second outer concave groove 42B is increased gradually along a second direction from the second end 401B to the second end 402B of the second inner concave groove 40B, the width (no label) of the second outer concave groove 42B is narrowed gradually along a second direction from the outer surface 401 to the inner surface 400 of the cap body 4, and the height (no label) of the second outer concave groove 42B is decreased gradually along the second direction from the outer surface 401 to the inner surface 400 of the cap body 4. However, the above-mentioned design for the second outer concave groove 42B of the first embodiment is merely an example and is not meant to limit the instant disclosure.

In conclusion, the two second inner concave grooves 40B can be formed on the inner surface 400 of the cap body 4 by a die casting process and the two first retaining blocks 41A and the two first outer concave grooves 42A can be concurrently formed by a dotting or punching machine, so that when the elastic piece 5 is disposed on the inner surface 100 of the cap body 4, the two first retaining blocks 41A can contact the elastic piece 5 for retaining the elastic piece 5, thus the production efficiency of manufacturing the cap structure S and the robustness of retaining the elastic piece 5 by the two first retaining blocks 41A can be increased.

The above-mentioned descriptions merely represent the preferred embodiments of the instant disclosure, without any intention or ability to limit the scope of the instant disclosure which is fully described only within the following claims. Various equivalent changes, alterations or modifications based on the claims of instant disclosure are all, consequently, viewed as being embraced by the scope of the instant disclosure.

What is claimed is:

1. A cap structure having an inner surface concave feature, comprising:

a cap body having at least two first retaining blocks corresponding to each other and at least two first outer concave grooves corresponding to each other and respectively adjacent to the at least two first retaining blocks, wherein the cap body has an inner surface, an outer surface and a bottom surface connected between the inner surface and the outer surface, and the at least two first outer concave grooves are disposed on the outer surface of the cap body; and an elastic piece disposed on the inner surface of the cap body, wherein the at least two first retaining blocks contact the elastic piece for retaining the elastic piece;

wherein the cap body has at least two first inner concave grooves corresponding to each other, the at least two first retaining blocks are respectively and outwardly extended from the at least two first inner concave grooves, and the at least two first inner concave grooves are disposed on the inner surface of the cap body;

wherein each first inner concave groove has a first end connected to the bottom surface of the cap body and a second end opposite to the first end and far away from the bottom surface of the cap body, and a width of the first inner concave groove is narrowed gradually from the first end to the second end of the first inner concave groove.

2. The cap structure of claim 1, wherein the at least two first inner concave grooves are diagonally disposed on the inner surface of the cap body, and the at least two first inner concave grooves are respectively adjacent to two opposite end sides of the cap body, wherein the at least two first retaining blocks are respectively and diagonally disposed on the at least two first inner concave grooves, and the at least two first retaining blocks are respectively adjacent to the two opposite end sides of the cap body, wherein the at least two first outer concave grooves are diagonally disposed on the outer surface of the cap body, and the at least two first outer concave grooves are respectively adjacent to the two opposite end sides of the cap body.

3. The cap structure of claim 1, wherein each first retaining block is adjacent to the second end of the corresponding first inner concave groove, a length of the first retaining block is increased gradually along a first direction from the first end to the second end of the first inner concave groove, a width of the first retaining block is narrowed gradually along a second direction far away from the first inner concave groove, and a height of the first retaining block is decreased gradually along the second direction far away from the first inner concave groove.

4. The cap structure of claim 1, wherein each first outer concave groove is adjacent to the second end of the corresponding first inner concave groove, a length of the first outer concave groove is increased gradually along a first direction from the first end to the second end of the first inner concave groove, a width of the first outer concave groove is narrowed gradually along a second direction from the outer surface to the inner surface of the cap body, and a height of the first outer concave groove is decreased gradually along the second direction from the outer surface to the inner surface of the cap body.

5. The cap structure of claim 1, wherein the cap body has at least two second inner concave grooves corresponding to each other, at least two second retaining blocks corresponding to each other and respectively extended outwardly from the at least two second inner concave grooves, and at least two second outer concave grooves corresponding to each other and respectively adjacent to the at least two second retaining blocks, the at least two second inner concave grooves are disposed on the inner surface of the cap body, the at least two second outer concave grooves are disposed on the outer surface of the cap body, and the at least two second retaining blocks contact the elastic piece for retaining the elastic piece.

6. The cap structure of claim 5, wherein the at least two second inner concave grooves are diagonally disposed on the inner surface of the cap body, and the at least two second inner concave grooves are respectively adjacent to two opposite end sides of the cap body, wherein the at least two second retaining blocks are respectively and diagonally disposed on the at least two second inner concave grooves, and the at least two second retaining blocks are respectively adjacent to the two opposite end sides of the cap body, wherein the at least two second outer concave grooves are diagonally disposed on the outer surface of the cap body, and the at least two second outer concave grooves are respectively adjacent to the two opposite end sides of the cap body.

7. A zipper head assembly structure, comprising:

a sliding member having a first retaining seat and a second retaining seat, wherein the first retaining seat has a hook groove, and the second retaining seat has a hook hole;

a pull tab having an end portion disposed between the first retaining seat and the second retaining seat;

a locking hook disposed on the sliding member, wherein the locking hook has a first end portion disposed inside the hook groove and a second end portion passing through the hook hole;

a cap body having two opposite end portions respectively disposed on the first retaining seat and the second retaining seat, wherein the cap body has at least two first retaining blocks corresponding to each other and at least two first outer concave grooves corresponding to each other and respectively adjacent to the at least two first retaining blocks, wherein the cap body has an inner surface, an outer surface and a bottom surface connected between the inner surface and the outer surface, and the at least two first outer concave grooves are disposed on the outer surface of the cap body; and an elastic piece disposed between the inner surface of the cap body and the locking hook and abutted against the locking hook, wherein the at least two first retaining blocks contact the elastic piece for retaining the elastic piece;

wherein the cap body has at least two first inner concave grooves corresponding to each other, the at least two first retaining blocks are respectively and outwardly extended from the at least two first inner concave grooves, and the at least two first inner concave grooves are disposed on the inner surface of the cap body;

wherein each first inner concave groove has a first end connected to the bottom surface of the cap body and a second end opposite to the first end and far away from the bottom surface of the cap body, and a width of the first inner concave groove is narrowed gradually from the first end to the second end of the first inner concave groove.

8. The zipper head assembly structure of claim 7, wherein the cap body has at least two first inner concave grooves corresponding to each other, the at least two first retaining blocks are respectively and outwardly extended from the at least two first inner concave grooves, and the at least two first inner concave grooves are disposed on the inner surface of the cap body.

9. The zipper head assembly structure of claim 8, wherein the at least two first inner concave grooves are diagonally disposed on the inner surface of the cap body, and the at least two first inner concave grooves are respectively adjacent to two opposite end sides of the cap body, wherein the at least two first retaining blocks are respectively and diagonally disposed on the at least two first inner concave grooves, and the at least two first retaining blocks are respectively adjacent to the two opposite end sides of the cap body, wherein the at least two first outer concave grooves are diagonally disposed on the outer surface of the cap body, and the at least two first outer concave grooves are respectively adjacent to the two opposite end sides of the cap body.

10. The zipper head assembly structure of claim 7, wherein the cap body has at least two second inner concave grooves corresponding to each other, at least two second retaining blocks corresponding to each other and respectively extended outwardly from the at least two second inner concave grooves, and at least two second outer concave grooves corresponding to each other and respectively adjacent to the at least two second retaining blocks, the at least two second inner concave grooves are disposed on the inner surface of the cap body, the at least two second outer concave grooves are disposed on the outer surface of the cap body, and the at least two second retaining blocks contact the elastic piece for retaining the elastic piece.

11. The zipper head assembly structure of claim 10, wherein the at least two second inner concave grooves are diagonally disposed on the inner surface of the cap body, and the at least two second inner concave grooves are respectively adjacent to two opposite end sides of the cap body, wherein the at least two second retaining blocks are respectively and diagonally disposed on the at least two second inner concave grooves, and the at least two second retaining blocks are respectively adjacent to the two opposite end sides of the cap body, wherein the at least two second outer concave grooves are diagonally disposed on the outer surface of the cap body, and the at least two second outer concave grooves are respectively adjacent to the two opposite end sides of the cap body.

12. A cap structure having an inner surface concave feature, comprising:

a cap body having at least two first retaining blocks corresponding to each other and at least two first outer concave grooves corresponding to each other and respectively adjacent to the at least two first retaining blocks, wherein the cap body has an inner surface, an outer surface and a bottom surface connected between the inner surface and the outer surface, and the at least two first outer concave grooves are disposed on the outer surface of the cap body; and an elastic piece disposed on the inner surface of the cap body, wherein the at least two first retaining blocks contact the elastic piece for retaining the elastic piece;

wherein the cap body has at least two first inner concave grooves corresponding to each other, the at least two first inner concave grooves are disposed on the inner surface of the cap body, and a width of each first inner concave groove is narrowed gradually.

13. The cap structure of claim 12, wherein the at least two first retaining blocks are respectively and outwardly extended from the at least two first inner concave grooves.

* * * * *